US006708626B2

(12) United States Patent
Ueda et al.

(10) Patent No.: US 6,708,626 B2
(45) Date of Patent: Mar. 23, 2004

(54) DOUBLE-WALLED DAMPING STRUCTURE

(75) Inventors: Hiroki Ueda, Kobe (JP); Ichiro Yamagiwa, Kobe (JP); Akio Sugimoto, Kobe (JP); Toshimitsu Tanaka, Kobe (JP); Narikazu Hashimoto, Shimonoseki (JP); Takashi Oka, Shimonoseki (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 10/160,001

(22) Filed: Jun. 4, 2002

(65) Prior Publication Data

US 2003/0000417 A1 Jan. 2, 2003

(30) Foreign Application Priority Data

Jun. 11, 2001 (JP) ..... 2001-175254
Jun. 11, 2001 (JP) ..... 2001-175439

(51) Int. Cl.[7] ..... B61D 17/10
(52) U.S. Cl. ..... 105/452; 105/422; 181/284
(58) Field of Search ..... 105/452, 401, 105/409, 422, 423; 296/183, 182, 187, 193; 244/119, 120, 121; 181/284, 285, 288, 292, 286; 52/144, 145

(56) References Cited

U.S. PATENT DOCUMENTS

| | | | | |
|---|---|---|---|---|
| 2,819,032 A | * | 1/1958 | Detrie et al. | 244/119 |
| 3,074,339 A | * | 1/1963 | Pennati | 454/296 |
| 3,420,192 A | | 1/1969 | Ellis | 105/422 |
| 3,831,710 A | * | 8/1974 | Wirt | 181/286 |
| 4,794,032 A | * | 12/1988 | Fujii et al. | 105/422 |
| 4,874,650 A | * | 10/1989 | Kitoh et al. | 428/68 |
| 4,966,082 A | | 10/1990 | Takeichi et al. | 105/422 |

(List continued on next page.)

FOREIGN PATENT DOCUMENTS

| | | |
|---|---|---|
| DE | 92 16 602 | 3/1994 |
| EP | 0 332 920 | 9/1989 |
| EP | 0 755 620 | 5/1997 |
| EP | 0 818 374 | 1/1998 |
| JP | 7-164584 | 6/1995 |

*Primary Examiner*—S. Joseph Morano
*Assistant Examiner*—Lars A. Olson
(74) *Attorney, Agent, or Firm*—Oblon, Spivak, McClelland, Maier & Neustadt, P.C.

(57) ABSTRACT

A double-walled damping structure includes two parallel face plates 1 and 2, a plurality of ribs 3 and 4 extending in the same direction to connect the two parallel face plates 1 and 2, wherein in a section taken perpendicularly to the direction of extension of the ribs 3 and 4, all or most of the holes defined by the adjacent two ribs and the face plates are trapezoidal. The structure less transmits vibration, and is capable of further increasing a damping effect when a damping material is attached. A double-walled sound insulation structure includes two parallel face plates 1 and 2 having a same thickness, a plurality of vertical ribs 3 extending in parallel with an equal pitch to connect the two parallel face plates 1 and 2, wherein assuming that the Young's modulus, density and thickness of each of the face plates are E, ρ, and t, respectively, and the pitch of the ribs is 1, the following equation (1) is satisfied:

[Formula 1]

$$250 \le \frac{k^2}{4\pi} \cdot \frac{t}{l^2} \cdot (E/3\rho)^{1/2} \le 5000 \quad (1)$$

(wherein $k = 4.72$)

The structure effectively exhibits a sound insulating effect by itself, and is capable of further increasing the sound insulating effect when a damping material is attached.

13 Claims, 12 Drawing Sheets

U.S. PATENT DOCUMENTS 5,339,745 A * 8/1994 Ritzl et al. ..... 105/452
5,383,406 A * 1/1995 Vanolo et al. ..... 105/401
5,403,063 A * 4/1995 Sjostedt et al. ..... 296/187
5,595,123 A * 1/1997 Tao et al. ..... 105/396
5,664,826 A 9/1997 Wilkens ..... 296/181
5,690,035 A 11/1997 Hatayama et al. ..... 105/452
5,749,302 A * 5/1998 Tegeler ..... 105/397
5,799,583 A * 9/1998 Bieker ..... 105/401
5,918,548 A * 7/1999 Elsner et al. ..... 105/397

* cited by examiner

DOUBLE-WALLED DAMPING STRUCTURE

BACKGROUND OF THE INVENTION

1. Field of the Invention

The present invention relates to a damping structure used for a portion required to prevent vibration noise, or a portion required to prevent noise by insulation from a sound source.

2. Description of the Related Art

Japanese Unexamined Patent Publication No. 7-164584 discloses a trussed damping structural material comprising two face plates and inclined ribs for connecting the face plates, wherein a damping resin is attached to either or both of the ribs and the face plates. Since the damping structural material is trussed, it has high cross section rigidity, and can thus increase a sound insulating effect when the damping resin is attached. Therefore, the damping structural material is suitable as a transport structure for, for example, railroad vehicles, or the like.

In the trussed structure disclosed in the above publication, as shown in FIGS. 17*a*, 17*b* and 17*c*, triangular holes are defined by two adjacent ribs and face plates. When deformation of one of the face plates transmits to the other face plate through the ribs, deformations of the two ribs are combined at the apex of each of triangles, and thus loads are applied to the face plates through the ribs in the normal direction, i.e., perpendicularly to the face plates, to push up the face plates (refer to an arrow in the drawing), thereby increasing vibration transmission. Also, the trussed structure has high rigidity and low cross section deformation to increase this phenomenon.

Since the trussed structure causes less cross section deformation, a damping material 5 attached to each of the ribs and the face plates is less distorted. The damping effect cannot be effectively exhibited unless the frequency is in a region in which the ribs and the face plates are deformed independently.

SUMMARY OF THE INVENTION

The present invention has been achieved in consideration of the above problems. An object of the present invention is to obtain a damping structure comprising a structure main body having a structure which less transmits vibration, and effectively exhibiting a damping function when damping treatment is performed with a damping material, and capable of securing necessary cross section rigidity. Another object of the present invention is to provide a shape and structure for effectively exhibiting the sound insulating effect of a structure body.

A damping structure according to the present invention is a double-walled damping structure comprising two parallel face plates; and a plurality of ribs extending in the same direction to connect said two parallel face plates, wherein in a section taken perpendicularly to the direction of extension of said ribs, all or most of holes defined by the surfaces of the adjacent two of said ribs and the inner surfaces of said face plates are quadrangular.

In the double-walled damping structure according to the present invention, less vibration is transmitted, because deformations of plural of the ribs are not combined at the junction of the rib and the face plate. Thus the damping function is effectively exhibited when damping treatment is performed, thereby more preventing vibration noise than a conventional example.

In the double-walled damping structure according to one aspect of the present invention, all or most of said ribs are inclined relative to said two face plates, and in a section taken perpendicularly to the direction of extension of said ribs, all or most of holes defined by the surfaces of the adjacent two of said ribs and the inner surfaces of said face plates are trapezoidal.

The holes defined by the adjacent two ribs and one of the face plates are triangular, and the holes defined by two adjacent ribs and both face plates are trapezoidal. In each of the trapezoidal holes, a space is formed between the junctions of each of the ribs and one of the face plates. In the present invention, "most" means a "majority".

In the double-walled damping structure described above, less vibration is transmitted, and furthermore, cross section rigidity as a structure can be secured.

In the double-walled damping structure described above, when a plurality of triangular holes defined by the surfaces of the adjacent two of said ribs and the inner surfaces of said face plates are present other than the trapezoidal holes in a section taken perpendicularly to the direction of extension of said ribs, all of the inner surfaces of the triangular holes are preferably included in only one of said face plates.

In the double-walled damping structure described above, in a section taken perpendicularly to the direction of extension of said ribs, when a plurality of triangular holes defined by the surfaces of the adjacent two of said ribs and the inner surfaces of said face plates are present other than the trapezoidal, the trapezoidal holes are preferably present between the respective triangular holes.

In the double-walled damping structure described above, in a section taken perpendicularly to the direction of extension of said ribs, triangular may be defined by the surfaces of the adjacent two of said ribs and the inner surfaces of said face plates only at both ends in the width direction.

By combining a plurality of the above-described double-walled damping structures as units in the width direction, it is possible to form a wide double-walled damping structure comprising two parallel face plates, and a plurality of ribs extending in the same direction, for connecting the two face plates.

A damping material may be attached to either or both of the face plates and the ribs, or the hollows between the face plates may be filled with a damping material such as a damping resin foam material or the like according to demand.

The double-walled damping structure may be an extruded product of aluminum or an aluminum alloy, or a molded product of a resin or mainly composed of a resin.

The double-walled damping structure according to another aspect of the present invention is a double-walled sound insulation structure comprising two parallel face plates having a same thickness, and a plurality of vertical ribs extending in parallel with a substantially equal pitch to connect the two parallel face plates.

In the double-walled damping structure described above, assuming that the Young's modulus, density and thickness of each of the face plates are E, ρ, and t, respectively, and the pitch of the ribs is 1, the following equation (1) is preferably satisfied:

$$250 \le \frac{k^2}{4\pi} \cdot \frac{t}{l^2} \cdot (E/3\rho)^{1/2} \le 5000 \quad (1)$$

(wherein $k = 4.72$)

In the structure, the acoustic radiation can be decreased efficiently due to the occurrence of cancellation in a radiated acoustic wave, thereby obtaining a high sound insulating effect.

DETAILED DESCRIPTION OF THE PREFERRED EMBODIMENTS

Figure 1A:
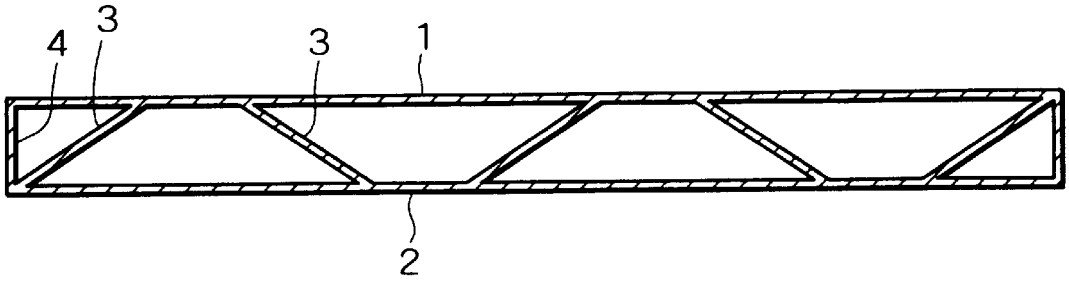
FIG. 1*a*, FIG. 1*b* and FIG. 1*c* are sectional views of double-walled damping structures according to the present invention.

A double-walled damping structure according to the present invention will be described in detail with reference to FIGS. 1 to 10.

FIG. 1(*a*) shows a double-walled damping structure comprising two parallel face plates 1 and 2, and a plurality of ribs (inclined ribs 3 and vertical ribs 4) extending in the same direction, for connecting the two face plates 1 and 2. In the sectional shape, the holes formed by the adjacent two ribs and the face plates include triangular holes at both ends in the width direction, and trapezoidal holes formed in the intermediate portion between both ends. FIG. 1(*b*) shows a structure in which a damping resin 5 is attached to the face plates 1 and 2, and the ribs 3. FIG. 1(*c*) shows a structure in which a damping resin 5 is attached to the face plate 1 and the ribs 3.

In the double-walled damping structure, most of the ribs are inclined relative to the face plates, and most of the holes defined by the adjacent two ribs and the face plates in the sectional shape are trapezoidal. The construction comprising trapezoidal holes in its sectional shape have low rigidity, and thus the face plates and the ribs are readily deformed to cause difficulties in transmission of deformation of one of the face plates to the other face plate through the ribs, as compared with the construction comprising triangular holes. Also, in the construction comprising trapezoidal holes, the junctions of the rib and one of the face plates are spaced concerning the adjacent two ribs, and thus loads applied the face plates little push the face plates upward in the normal direction. Therefore, vibration is decreased as compared with a conventional trussed structure. Furthermore, the face plates and the ribs easily cause bending deformation to effectively exhibit the damping function of a damping material. In the construction comprising trapezoidal holes, necessary cross section rigidity can be secured by the inclined ribs.

The double-walled damping structure comprises, for example, an extruded material of aluminum or an aluminum alloy, or a molded product of a resin or mainly composed of a resin. Other raw materials such as copper and the like may be used. Although the face plates 1 and 2 and the ribs 3 and 4 are integrally connected in FIGS. 1*a*, 1*b* and 1*c*, these members may be integrated by welding, bonding, or the like.

Figure 2A:
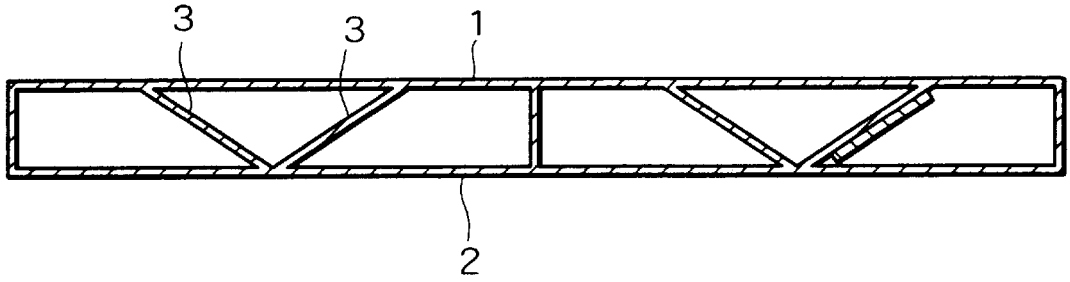
FIG. 2*a*, FIG. 2*b* and FIG. 2*c* are sectional views of double-walled damping structures according to another embodiments of the present invention.
Figure 2B:
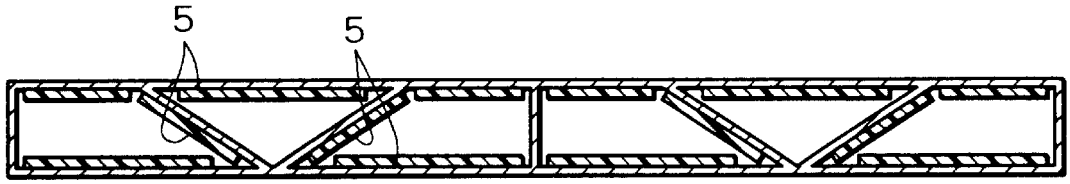
Figure 2C:
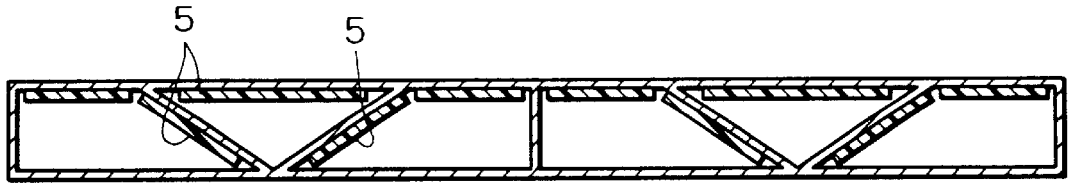

FIGS. 2(*a*) to (*c*) show a double-walled damping structure according to another embodiment of the present invention. In this double-walled damping structure, more than half of the holes defined by adjacent two ribs and face plates are trapezoidal in a section taken perpendicularly to the direction of extension of the ribs, and other holes are triangular. All apexes (the bottoms respectively comprise portions of a face plate 1) of the triangular holes defined by adjacent ribs 3 are positioned on a face plate 2, and the triangular holes are spaced with the trapezoidal holes provided therebetween.

Figure 1B:
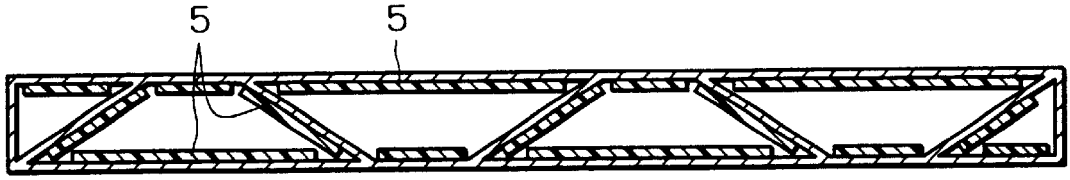
Figure 1C:
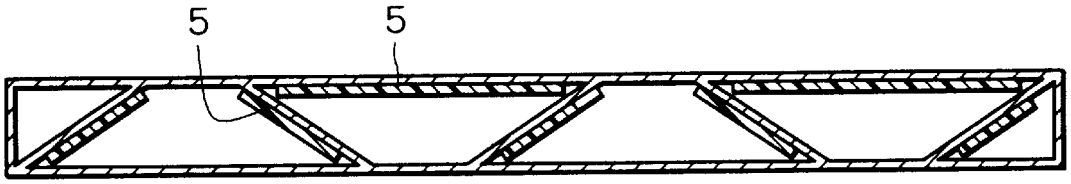

Since most of the holes in the sectional shape of the double-walled damping structure, which are defined by two ribs and face plates, are the trapezoidal holes, the same function and effect as the double-walled damping structures shown in FIGS. 1*a*, 1*b* and 1*c* are exhibited. Some of the holes in the sectional shape of the double-walled damping structure are the triangular holes, where the structure has high rigidity. However, since all apexes of the triangular holes defined by the adjacent ribs 3 are positioned on the side of the face plate 2, a load which pushes the face plate 1 upward in the normal direction is not applied to the face plate 1 from the ribs 3 when a sound source is positioned near the face plate 2. Therefore, transmission of vibration to the residence side (from the face plate 2 side to the face plate 1 side) can be prevented. Furthermore, the inclined ribs 3 which define the triangular holes also define the adjacent trapezoidal holes in the sectional shape, thereby contributing to the prevention of transmission of vibration.

Figure 3A:
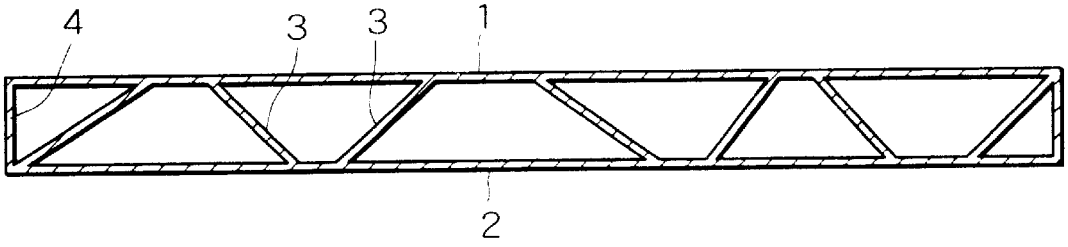
FIG. 3*a*, FIG. 3*b* and FIG. 3C are sectional views of double-walled damping structures according to further embodiments of the present invention.
Figure 3B:
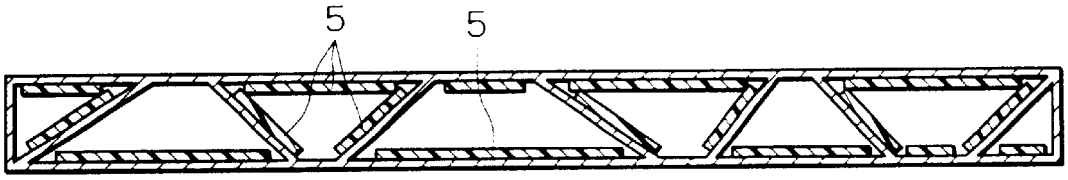
Figure 3C:
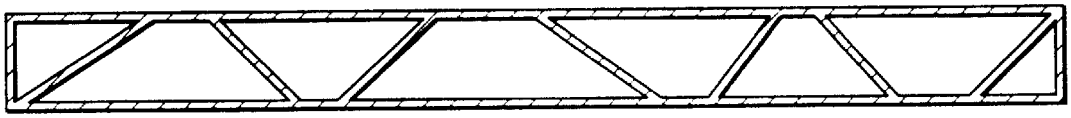

FIG. 3 shows a double-walled damping structure according to a further embodiment of the present invention. In this embodiment, holes defined by adjacent ribs and face plates in the sectional shape include triangular holes at both ends in the width direction, and trapezoidal holes in the intermediate portion between both ends. This embodiment is different from the double-walled damping structures shown in FIGS. 1*a*, 1*b* and 1*c* in that the shapes of the trapezoidal holes are not constant. However, the function of this embodiment is the same as that shown in FIGS. 1*a*, 1*b* and 1*c*. The vertical ribs 4 formed at both ends in the width direction (in the same way as FIGS. 1*a*, 1*b* and 1*c*) are formed from the viewpoint of assembly and installation of the double-walled damping structure, not from the viewpoint of damping function.

When a wide double-walled damping structure is required, a narrow double-walled damping structure is used as a unit, and a plurality of the units are combined in the width direction. For example, when an aluminum alloy extruded material is used, it is realistic to combine a plurality of units in the width direction because an extrudable range is limited from the viewpoint of production. In order to combine a plurality of units in the width direction, welding, bonding, or another combining means can be appropriately used.

Figure 4A:
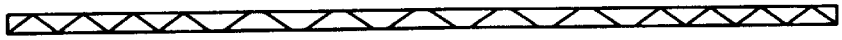
FIG. 4*a* and FIG. 4*b* are sectional views of double-walled damping structures according to still further embodiments of the present invention.
Figure 4B:
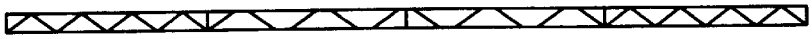

The double-walled damping structure of the present invention can be used as a part of a structural member in the width direction, which comprises two parallel face plates and a plurality of ribs extending in the same direction, for connecting the face plates. For example, in the structural member shown in FIG. 4*a*, conventional trussed structures are formed at both ends in the width direction, and the double-walled damping structure of the present invention is formed in the intermediate portion between both ends in the width direction. The structural member in FIG. 4*a* can comprise, for example, an integrally extruded material. As shown in FIG. 4*b*, four structural materials (two intermediate materials each comprising the double-walled damping structure of the present invention) each comprising an extruded material may be combined to form an integral structural member as one unit.

In the double-walled damping structure of the present invention, the sectional shape is fundamentally constant at any position in the length direction (perpendicular to the drawing). Here, "fundamentally constant" means that the total width need not be constant over the total length in the length direction, and the sectional shape may have a wide portion and a narrow portion in the length direction.

EXAMPLE 1

Figure 5A:
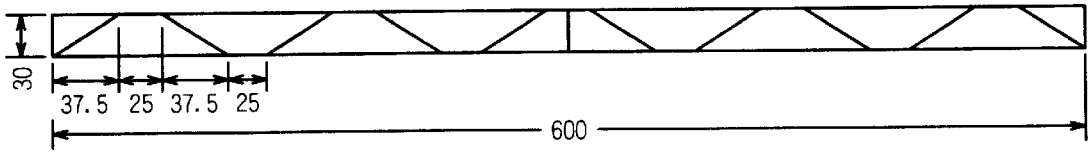
FIG. 5*a*, FIG. 5*b*, FIG. 5*c* and FIG. 5*d* are schematic sectional views showing double-walled damping structures used for a vibration test.

Experiment was carried out on the damping function of the double-walled damping structure of the present invention. Structure objects of experiment included the structures as shown in FIGS. 5*a*, 5*b*, 5*c* and 5*d*. The structure shown in FIG. 5*a* was an aluminum alloy extruded material comprising two face plates having a thickness of 2 mm, ribs having a projection length (projected on the face plate) of 37.5 mm and a thickness of 2 mm and vertical ribs at both ends and the center. The structure had a thickness of 30 mm and a width of 600 mm. In the sectional shape, it comprised triangular holes at both ends and trapezoidal holes which had a long bottom of a length of 100 mm and a short bottom of a length of 25 mm. The structure shown in FIG. 5*b* comprised an extruded material as shown in FIG. 5*a* and a damping resin having a thickness of 3 mm attached to each of the face plates and the ribs. The structure shown in FIG. 5*c* was a trussed aluminum alloy extruded material comprising two face plates having a thickness of 2 mm and ribs having a thickness of 2 mm. The structure had a thickness of 30 mm and a width of 600 mm. The rib pitch of the structure was 37.5 mm. The structure shown in FIG. 5*d* comprised an extruded material as shown in FIG. 5*c* and a damping resin having a thickness of 3 mm attached to each of the face plates and the ribs.

Figure 6:
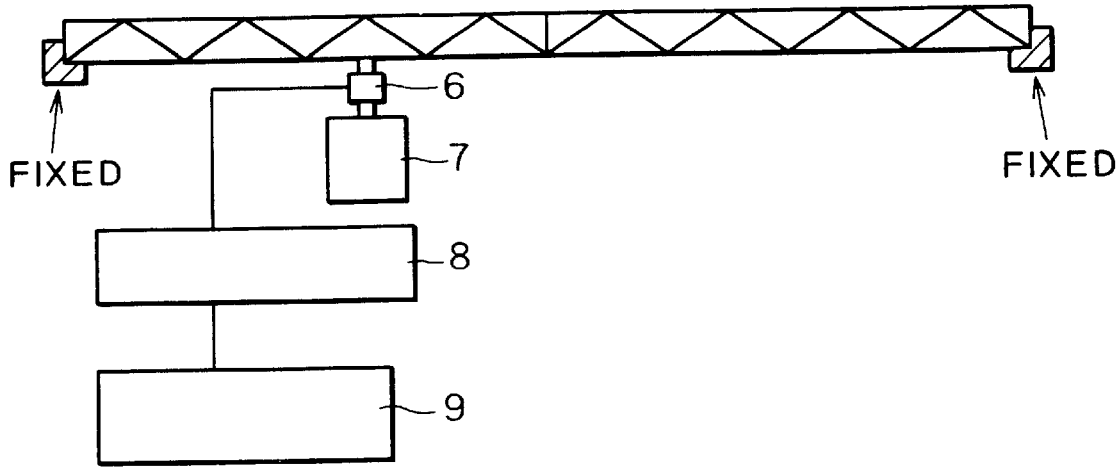
FIG. 6 is a schematic drawing illustrating the vibration test.

Each of these structures was subjected to a vibration test by the method shown in FIG. 6. Namely, both ends of the structure were fixed, and a portion of one of the face plates was supported by a vibrator 7 through an impedance head 6. Signal lines of exciting force and a vibration velocity measured by the impedance head 6 were connected to a frequency analyzer 9 through a charge amplifier 8. The impedance head 6 contained a load cell and a piezoelectric acceleration watch, and served as a sensor for simultaneously measuring exciting force and vibration.

Since wave vibration was produced by the vibrator while continuously changing the frequency from 500 Hz to 3000 Hz, to measure the vibration velocity and exciting force by the impedance head 6. The ratio of vibration velocity/exciting force was calculated from the measured vibration velocity and exciting force by the frequency analyzer 9 and then output. The obtained results are shown in FIGS. 7 and 8.

Figure 7:
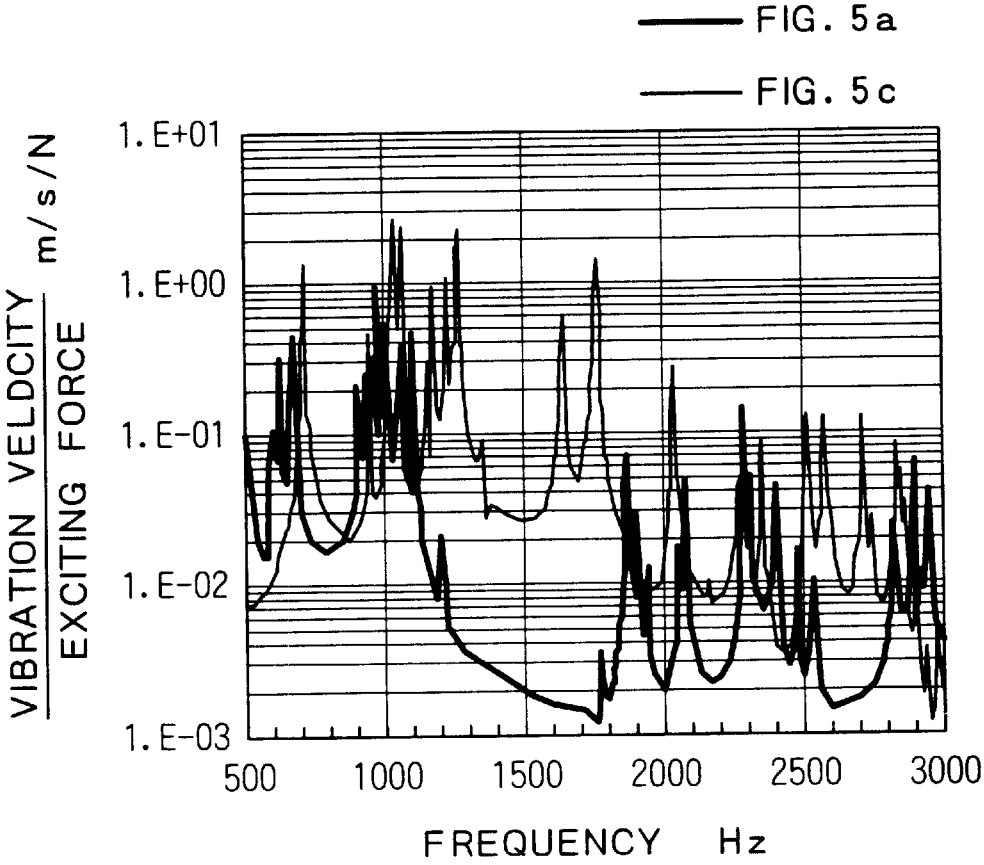
FIG. 7 is a graph showing the results of the vibration test.
Figure 8:
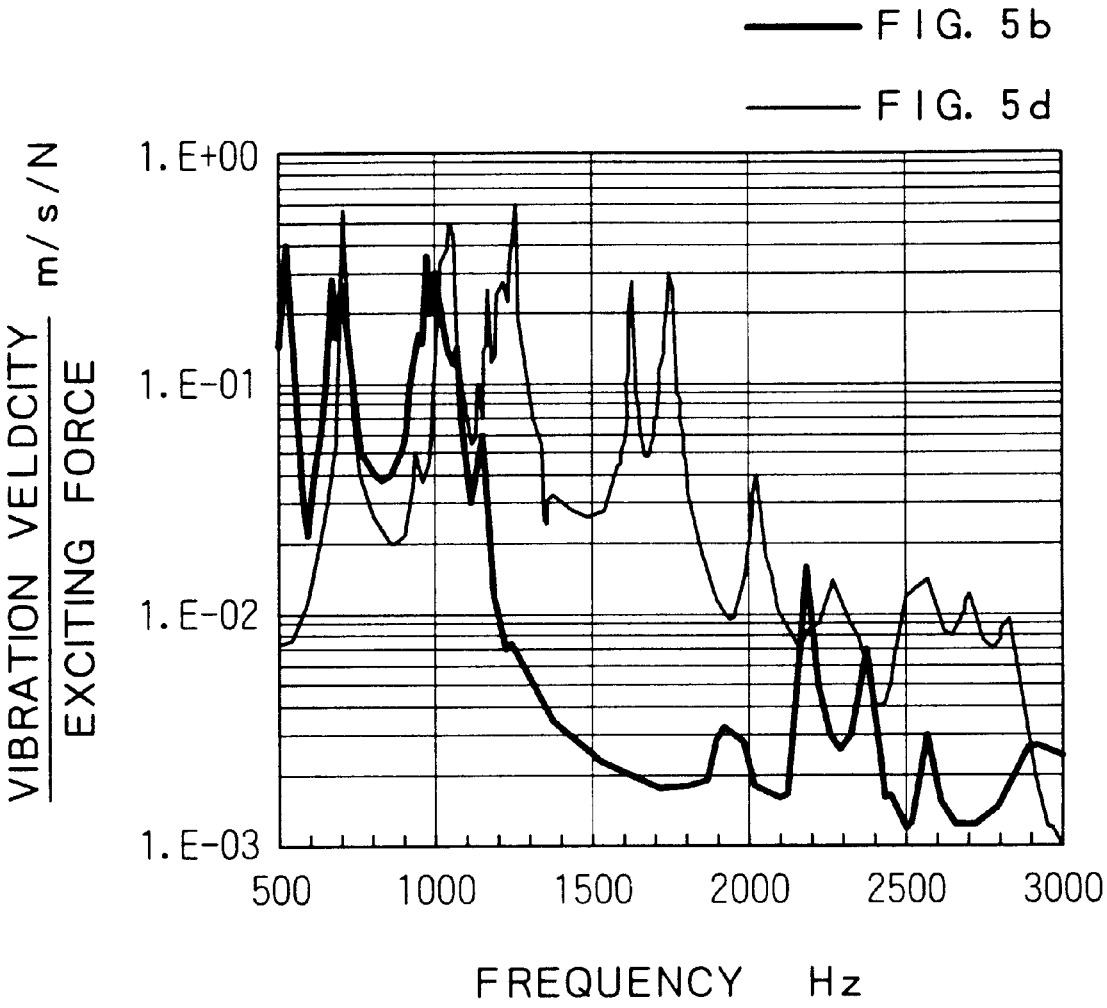
FIG. 8 is a graph showing the results of the vibration test.

FIG. 7 showing the results of the structures without damping treatment indicates that the double-walled damping structure as shown FIG. 5*a* of the present invention exhibits great damping of vibration, as compared with the trussed structure as shown in FIG. 5*c*. FIG. 8 showing the results of the structures with damping treatment indicates that the double-walled damping structure as shown in FIG. 5*b* of the present invention and the trussed structure as shown in FIG. 5*d* has a large difference, and the effect of the damping function of the damping material is significantly exhibited.

EXAMPLE 2

When an acoustic wave at a frequency of not less than the characteristic frequency of the face plates is incident on one of the face plates of a double-walled damping structure, the double-walled damping structure vibrates in a specified deformation mode. The deformation mode was analyzed by a finite element method. The results of analysis were compared with those of a conventional trussed structure.

Figure 5B:
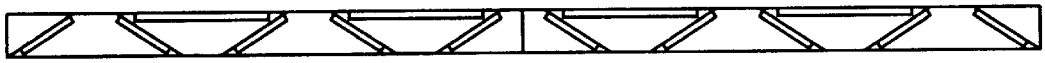
Figure 5C:
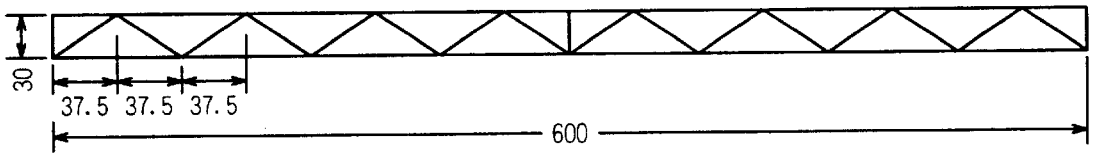
Figure 5D:
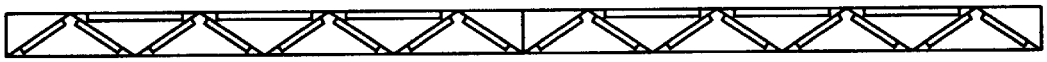

The structure objects of analysis were the structures shown in FIGS. 5*b* and 5*d*. For analysis, an aluminum alloy had a Young's modulus E 69 GPa, a density ρ of 2700 $kg/m^3$, and the damping resin had a Young's modulus of 2 GPa, and a density ρ of 1500 $kg/m^3$.

Figure 9B:
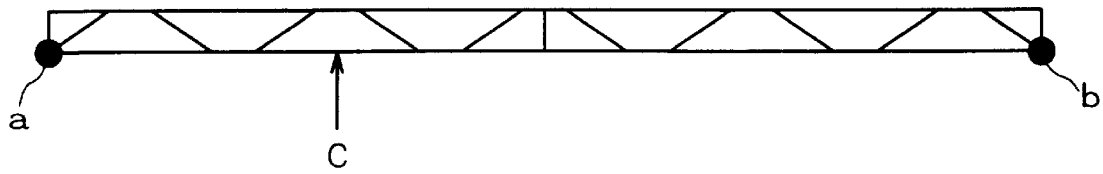
FIG. 9*b* and FIG. 9*d* are schematic sectional views showing double-walled damping structures used as objects of analysis by a finite element method.
Figure 9D:
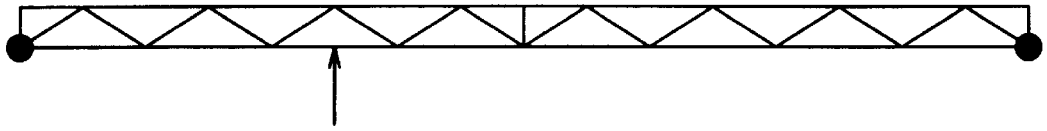

For each of the structures, the model shown in FIG. 9 was formed for analysis by the finite element method, in which nodal points a and b were fixed as shown in FIG. 9, and vibration was produced at nodal point c of one of the face plates to vibrate each of the structures. In the structure shown in FIG. 5*b*, the vibration frequency was 1880 Hz, while in the structure shown in FIG. 5*d*, the vibration frequency was 1640 Hz.

Figure 10B:
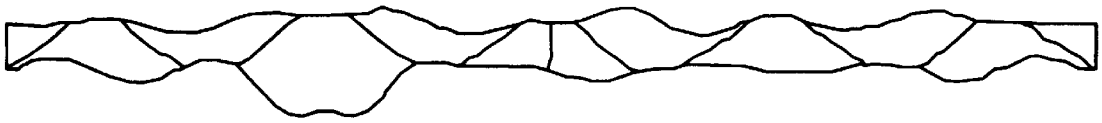
FIG. 10*b* and FIG. 10*d* are diagrams showing the results of analysis of the deformation mode of a double-walled damping structure.
Figure 10D:
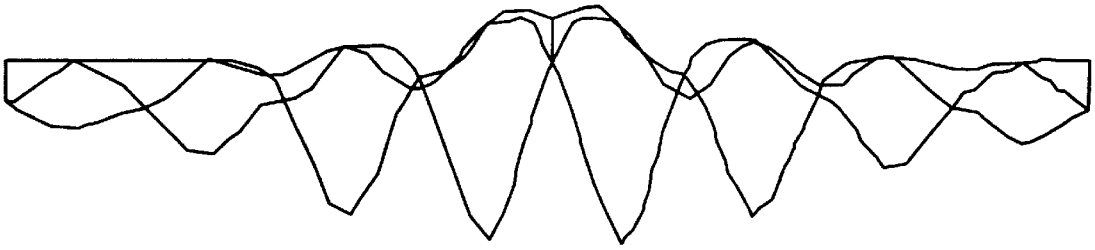

FIG. 10 shows the result of analysis. FIGS. 10*b* and 10*d* show deformation modes of the structures shown in FIGS. 5*b* and 5*d*, respectively, during vibration. In FIG. 10*b*, vibration is significantly damped, as compared with the case shown in FIG. 10*d*.

Another kind of embodiments according to the present invention are described below. Since the embodiments are especially effective in sound insulating, they are referred to double-walled sound insulation structures hereinbelow.

Figure 11:
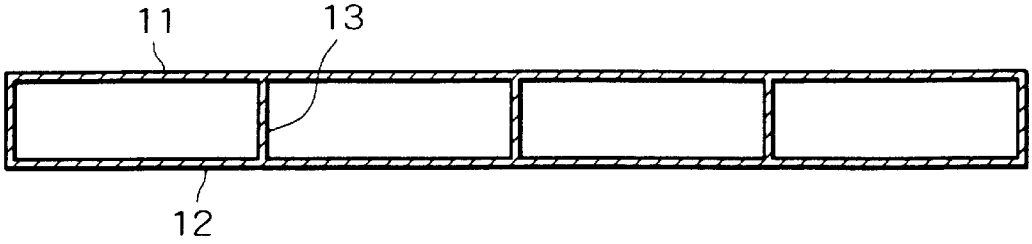
FIG. 11 is a sectional view of a double-walled sound insulation structure according to the present invention.
Figure 12A:
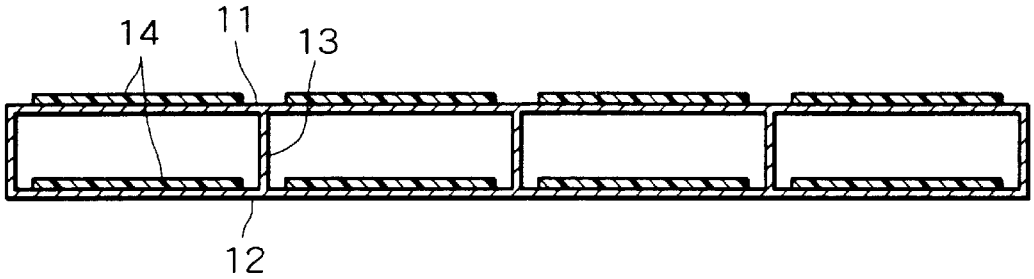
FIG. 12*a*, FIG. 12*b*, FIG. 12*c* and FIG. 12*d* are sectional views showing double-walled sound insulation structures subjected to damping treatment.
Figure 12B:
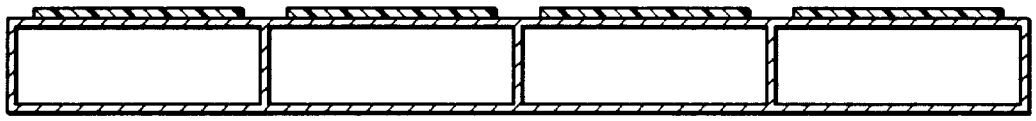
Figure 12C:
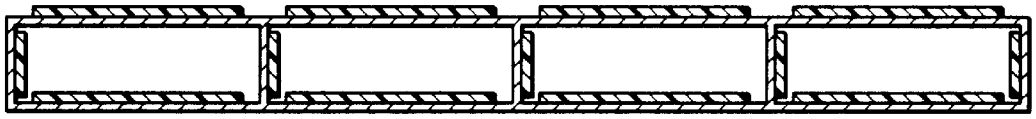
Figure 12D:
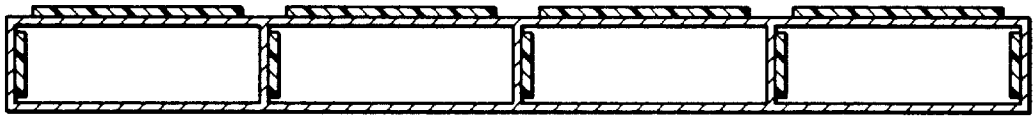

As illustrated in FIG. 11, a double-walled sound insulation structure of the present invention comprises two parallel face plates 11 and 12 having a same thickness, and a plurality of vertical ribs 13 extending in parallel with an equal pitch in the length direction (perpendicular to the drawing), for connecting the two face plates 11 and 12 in the vertical direction. In the sound insulation structure, the sectional shape is fundamentally constant at any position in the length direction (perpendicular to the drawing). Here, "fundamentally constant" means that the total width need not be constant over the total length in the length direction, and the sectional shape may have a wide portion and a narrow portion in the length direction.

The double-walled sound insulation structure comprises, for example, an extruded material of aluminum or an aluminum alloy, or a molded product of a resin or mainly composed of a resin. Other raw materials such as copper and the like may be used. The face plates 11 and 12 have the same quality and characteristics, while the ribs 3 do not necessarily have the same quality or characteristics as the face plates 11 and 12. Although the face plates 11 and 12 and the ribs 13 are integrally connected in FIG. 11, these members may be integrated by welding, bonding, or the like.

FIGS. 12*a*, 12*b*, 12*c* and 12*d* show examples of the double-walled sound insulation structure in which a damping resin 14 is attached to the face plates 11 and 12 or the ribs 13. As disclosed in the above-described Japanese Unexamined Patent Publication No. 7-164584, asphalt resins, butyl rubber-type special synthetic rubber, and the like can be used as the damping resin 14. These resins can be attached to the face plates 11 and 12 or the ribs 13 by bonding or heat melting. This can further improve the damping function of the double-walled sound insulation structure to increase the sound insulating effect. Also, the hollow portions of the double-walled sound insulation structure may be filled with a damping material such as a resin foam damping material, or the like.

The middle part of the above equation (1) represents the lowest-order characteristic frequency f of the face plates 11 and 12 of the double-walled sound insulation structure. Namely, in the present invention, the material quality and thickness of each of the face plates are set so that the characteristic frequency f of the face plates is in the range of 250 to 5000 Hz. When an acoustic wave at a frequency of the characteristic frequency f or more is incident on one of the face plates of the double-walled wound insulation structure, the double-walled sound insulation structure causes characteristic vibration in a specified deformation mode. The deformation mode was analyzed by a finite element method. A comparison of the results with a conventional trussed structure is described below.

Figure 13A:
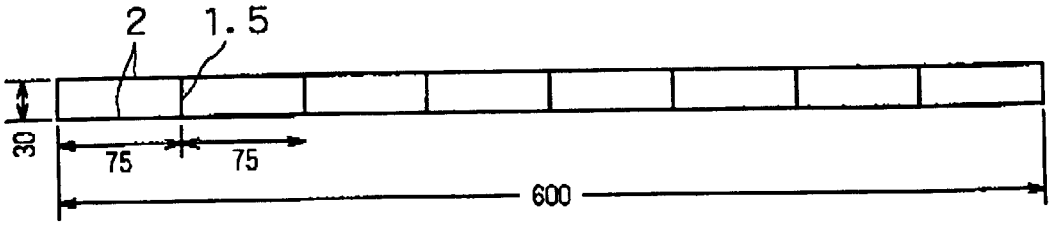
FIG. 13*a*, FIG. 13*b* and FIG. 13*c* are schematic sectional views showing double-walled sound insulation structures used as objects of analysis by a finite element method.
Figure 13B:
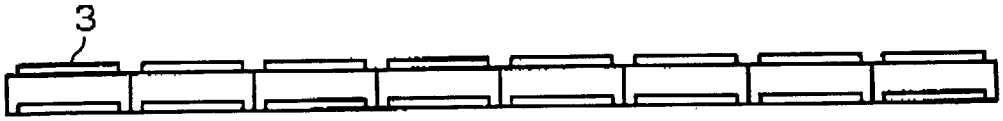
Figure 13C:
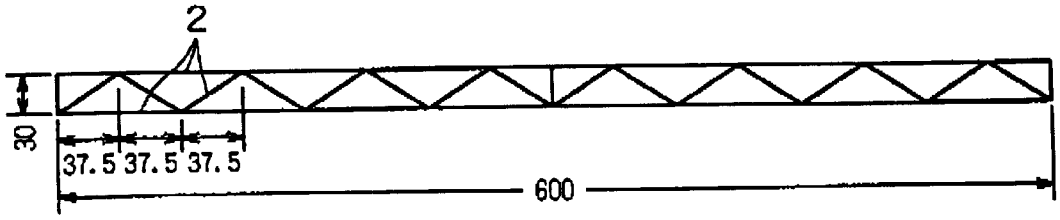

Structure objects of the analysis are shown in FIGS. 13*a*, 13*b* and 13*c*. The structure shown in FIG. 13*a* was an aluminum alloy extruded material comprising two face plates having a thickness 2 mm and ribs having a thickness of 1.5 mm. The structure had a thickness of 30 mm, a width of 600 mm and a rib pitch of 75 mm. The structure shown in FIG. 13*b* comprised an extruded material as shown in FIG. 13*a* and a damping resin having a thickness of 3 mm attached to each of the face plates and the ribs. The structure shown in FIG. 13*c* was a trussed aluminum alloy extruded material comprising two face plates having a thickness of 2 mm and ribs having a thickness of 2 mm. The structure had a thickness of 30 mm and a width of 600 mm, and a rib pitch of 37.5 mm. An aluminum alloy had a Young's modulus E 69 GPa, a density ρ of 2700 kg/m$^3$, and the damping resin had a Young's modulus of 2 GPa, and a density ρ of 1500 kg/m$^3$.

Figure 14A:
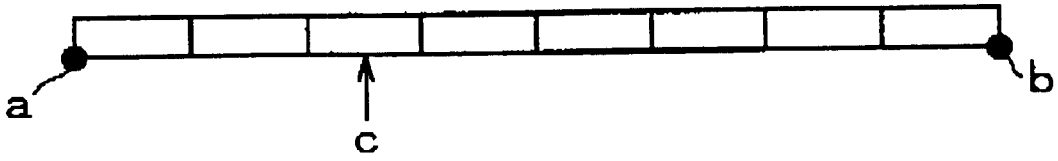
FIG. 14*a*, FIG. 14*b* and FIG. 14*c* are drawings showing analysis modes of the structures shown in FIG. 13*a*, FIG. 13*b* and FIG. 13*c*.
Figure 14B:
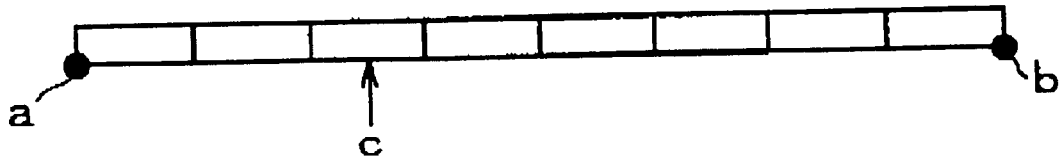
Figure 14C:
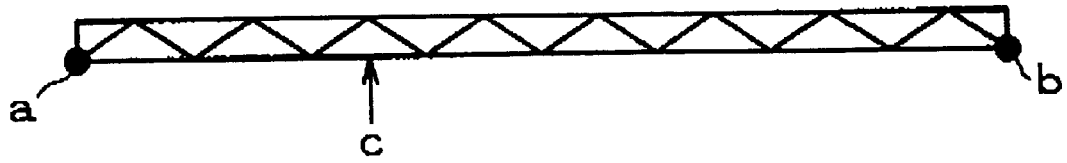

For these structures, the models shown in FIGS. 14*a* to 14*c* were formed for analysis by the finite element method, in which node points a and b were fixed, and node point c of a face plate was excited from below to vibrate each structure. The node points represent points in the analysis model for the finite element method. FIGS. 14*a* to 14*c* correspond to FIGS. 13*a* to 13*c*, respectively.

In the cases shown in FIGS. 13*a* and 13*b*, the vibration frequency was 2200 Hz, and in the case shown in FIG. 13*c*, the frequency was 2030 Hz. Both frequencies were close to the high-order characteristic frequency.

Figure 15A:
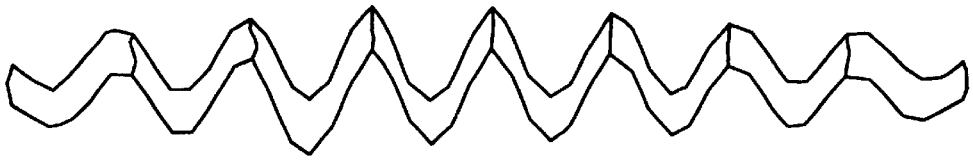
FIG. 15*a*, FIG. 15*b* and FIG. 15*c* are drawings showing the results of analysis of the deformation mode of double-walled sound insulating structures.
Figure 15B:
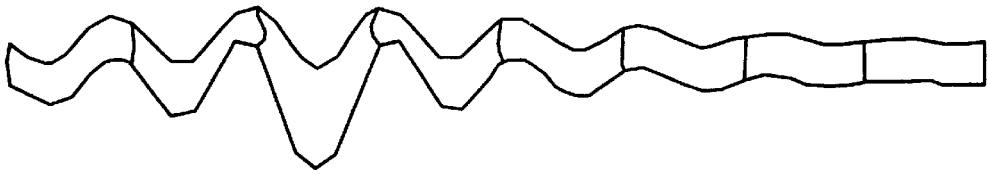
Figure 15C:
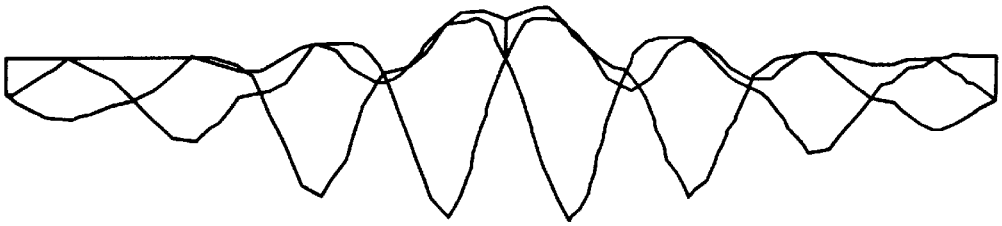

The results of analysis are shown in FIGS. 15*a* to 15*c*. FIGS. 15*a* to 15*c* show the deformation modes of the structures shown in FIGS. 13*a* to 13*c*, respectively, during vibration. In the structure of FIG. 15*a*, the upper and lower face plates are deformed in a same manner, and deformation regularly propagates in the lateral direction. In the structure of FIG. 15*b*, the form of the structure is substantially maintained, but the amplitude is damped. In the structure of FIG. 5*c*, both face plates are deformed in completely different manners, and deformation irregularly propagates in the lateral direction.

Figure 16:
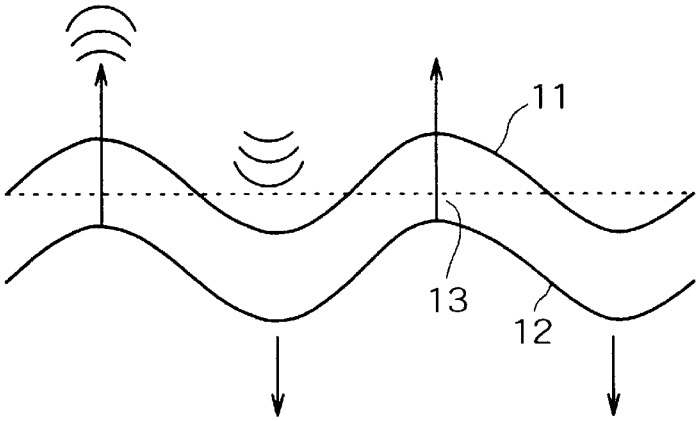
FIG. 16 is a drawing schematically illustrating the results of analysis of the deformation mode.
Figure 17A:
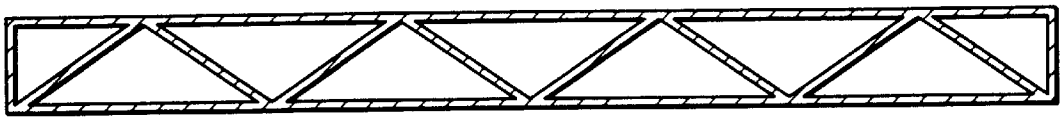
FIG. 17*a*, FIG. 17*b* and FIG. 17*c* are sectional views of conventional damping structures.
Figure 17B:
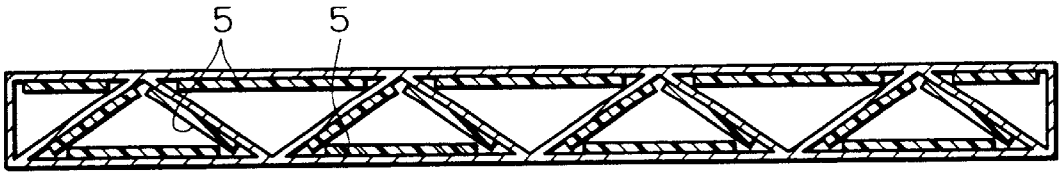
Figure 17C:
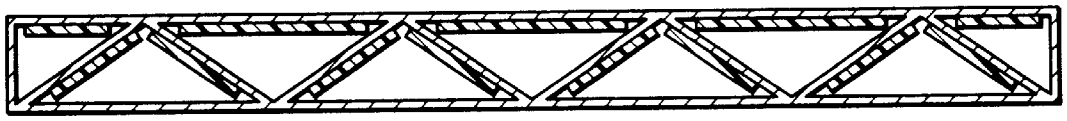

FIG. 16 schematically shows the deformation mode shown in FIG. 15*a* during vibration. In the deformation mode of the upper face plate related to sound radiation, deformation (above a broken line) near each rib is symmetrical to deformation of an intermediate portion (below the broken line). Therefore, even when vibration of the face plates has a high amplitude, an acoustic wave radiated from vibration causes cancellation between adjacent positions to decrease the acoustic radiation efficiency, thereby decreasing sound. In FIG. 15*b*, deformation near each rib is symmetrical to an intermediate portion, and at the same time, vibration is damped itself, thereby further decreasing the acoustic radiation efficiency to decrease sound.

On the other hand, in the case shown in FIG. 15*c*, the radiated acoustic wave causes no cancellation to fail to decrease the acoustic radiation efficiency, thereby failing to decrease sound.

In order to cause the cancellation in an acoustic wave, as described above, the double-walled sound insulation structure must be formed by using two parallel face plates having the same thickness, and vertical ribs with an equal pitch, for connecting the face plates. The ribs need not be perpendicular to the face plates in a mathematical sense, and may be perpendicular to the face plates in a substantial sense (the ribs are allowed to be inclined to some extend in a range causing no interference with the sound insulating ability). Similarly, the requirements for the ribs to be arranged in parallel with an equal pitch should be interpreted in a substantial sense.

A description will now be made of the reason for setting the material quality and thickness of the face plates, and the rib pitch so that the characteristic frequency f of the face plates is in the range of 250 to 5000 Hz in the double-walled sound insulation structure of the present invention.

As described above, when an acoustic wave at a frequency of not less than the characteristic frequency f of the face plates is incident to the double-walled sound insulation structure of the present invention, the structure vibrates in the above-described deformation mode, and exhibits the sound insulating effect by cancellation in the acoustic wave. Namely, the double-walled sound insulation structure has the effect of insulating sound of an acoustic wave at a frequency of the characteristic frequency f or more. Therefore, the effect of insulating sound can be obtained in a wide range of frequency by setting the characteristic frequency f small.

On the other hand, a threshold sound pressure level (effective value) audible to human ears is referred to as "the minimum audible threshold", which depends upon the frequency. At a frequency of 500 Hz or less, the sensitivity of ears deteriorates as the frequency decreases, and particularly, at a frequency of 250 Hz or less, the minimum audible threshold is increased. Therefore, in order to obtain a sound insulation structure having high efficiency, it is said to be realistic to set the characteristic frequency f to 250 Hz or more. In consideration of other factors such as the cross section rigidity of the structure, etc., the frequency may be set to 500 Hz or more. At a frequency of 5000 Hz or more, the sensitivity of ears deteriorates as the frequency increases, and the minimum audible threshold is increased. Therefore, it is meaningless to set the characteristic frequency f to over 5000 Hz. For these reasons, in the double-walled sound insulation structure of the present invention, the characteristic frequency f is set to 250 to 5000 Hz. In order to securely cover the range of 3000 to 4000 Hz in which the minimum audible threshold generally becomes the lowest, the characteristic frequency f is generally preferably set to a range of 3000 Hz or less or 2000 Hz or less.

Examples of aluminum alloys used for the double-walled damping structure include aluminum alloys based on 2000-series, 5000-series, 6000-series and 7000-series component standards of AA or JIS. However, aluminum alloys other than the aluminum alloys based on AA or JIS standards, or aluminum alloys other than the aluminum alloys based on the above-described component standards may be used as long as requirements for use as a structural member are satisfied.

Furthermore, the aluminum or aluminum alloy extruded material can be produced by normal extrusion. For example, an aluminum or aluminum alloy melt prepared by melting is cast by a normal dissolved casting method appropriately selected, and the resultant ingot is homogenized and then subjected to extrusion and tempering (annealing, solution treatment, aging, stabilizing, and the like) to form an extruded material having a predetermined sectional shape. In the extruded material, both face plates and the ribs are preferably integrated.

Instead of the production of the extruded material in which both face plates and the ribs are integrated, aluminum or aluminum alloy rolled plates prepared by hot-rolling, cold rolling and tempering may be integrated by welding or bonding to form a material having a predetermined sectional shape, or extruded materials and rolled plates may be integrated by welding or bonding to form a material having a predetermined sectional shape.

In the resin molded product, the resin may be either a thermoplastic resin or a thermosetting resin. Examples of thermoplastic resins include polyethylene, polypropylene, polystyrene, AS resins, ABS resins, polyvinyl chloride, polyamide (nylon), polyethylene terephthalate, polybtylene terephthalate, polycarbonate, polyacetal, polyphenylene oxide, polysulfone, PPS resins, and the like. Examples of thermosetting resins include unsaturated polyester resins, epoxy resins, phenol resins, vinyl ether resins, polyimide resins, polyurethane, and the like. The resin is not limited to these resins. In addition, at least two of these resins may be blended or alloyed as long as they are sufficiently compatible with each other. Furthermore, in order to improve the mechanical properties of the resins, glass fibers, carbon fibers, aramid fibers, organic fibers such as nylon fibers, or the like may be combined. These fibers maybe either continuous long fibers or short fibers called chipped or milled fibers. In order to control moldability and improve mechanical properties, a filler such as a calcium carbonate powder, talc, or the like, various additives are added in some cases to the combination of the resins and fibers.

In order to produce the double-walled damping structure by using any of the above resins and resin composites, a generally used resin molding method is used. However, particularly, an extrusion molding method is preferably used for the thermoplastic resin or a composite thereof, and a pultrusion molding method is preferably used for the thermosetting resin or a composite thereof.

We claim:

1. A double walled damping structure comprising:

two parallel face plates; and a plurality of ribs extending in the same direction to connect said two parallel face plates, wherein said ribs comprise at least two adjacent inclined ribs, wherein in a section taken perpendicularly to the direction of extension of said ribs, a hole defined by the surfaces of the adjacent two inclined ribs and the inner surfaces of said face plates are quadrangular such that vibrations from one of said face plates to the other of said face plates are reduced, wherein all or most of said ribs are inclined relative to said two face plates, and in a section taken perpendicularly to the direction of extension of said ribs, all or most of holes defined by the surfaces of the adjacent two of said ribs and the inner surfaces of said face plates are trapezoidal.

2. The double-walled damping structure according to claim 1, wherein hollow portions between said face plates are filled with a damping material.

3. The double-walled damping structure according to claim 1, wherein when a plurality of triangular holes defined by the surfaces of the adjacent two of said ribs and the inner surfaces of said face plates are present other than the trapezoidal holes in a section taken perpendicularly to the direction of extension of said ribs, all of the inner surfaces of the triangular holes are included in only one of said face plates.

4. The double-walled damping structure according to claim 1, wherein in a section taken perpendicularly to the direction of extension of said ribs, when a plurality of triangular holes defined by the surfaces of the adjacent two of said ribs and the inner surfaces of said face plates are present other than the trapezoidal holes in a section taken perpendicularly to the direction of extension of said ribs, the trapezoidal holes are present between the respective triangular holes.

5. The double-walled damping structure according to claim 1, wherein in a section taken perpendicularly to the direction of extension of said ribs, triangular holes are defined by the surfaces of the adjacent two of said ribs and the inner surfaces of said face plates only at both ends in the width direction.

6. The double-walled damping structure comprising a combination of a plurality of double-walled damping structures according to claim 1 as units.

7. The double-walled damping structure according to claim 1, wherein said face plates and said ribs are extruded products of an aluminum or aluminum alloy.

8. The double-walled damping structure according to claim 1, wherein said face plates and said ribs are molded products of a resin or a composite material mainly composed of a resin.

9. The double-walled damping structure according to claim 1, wherein a damping material is attached to at least one of said face plates and said ribs.

10. The double-walled damping structure according claim 1, wherein said two parallel face plates have a same thickness, and all or most of said ribs are perpendicular to said two parallel face plates with a substantially equal pitch to connect said two parallel face plates.

11. The double-walled damping structure according claim 10, wherein assuming that the Young's modulus, density and thickness of each of said face plates are E, ρ, and t, respectively, and the pitch of said ribs is 1, the following equation (1) is satisfied:

[Formula 1]

$$250 \leq \frac{k^2}{4\pi} \cdot \frac{t}{l^2} \cdot (E/3\rho)^{1/2} \leq 5000 \quad (1)$$

(wherein $k = 4.72$).

12. A double walled damping structure comprising:

two parallel face plates; and a plurality of inclined ribs extending in the same direction to connect said two parallel face plates, wherein in a section taken perpendicularly to the direction of extension of said ribs, all of the holes defined by the surfaces of an adjacent two of said ribs and the inner surfaces of said face plates are quadrangular such that vibrations from one of said face plates to the other of said face plates are reduced.

13. A double walled damping structure comprising:

two parallel face plates; and a plurality of inclined ribs extending in the same direction to connect said two parallel face plates, wherein in a section taken perpendicularly to the direction of extension of said ribs, all or most of the holes defined by the surfaces of the adjacent two of said ribs and the inner surfaces of said face plates are quadrangular such that vibrations from one of said face plates to the other of said face plates are reduced.

* * * * *

UNITED STATES PATENT AND TRADEMARK OFFICE

CERTIFICATE OF CORRECTION

PATENT NO. : 6,708,626 B2
DATED : March 23, 2004
INVENTOR(S) : Ueda et al.

It is certified that error appears in the above-identified patent and that said Letters Patent is hereby corrected as shown below:

Title page,
Item [73], Assignee, is incorrect should read
-- [73] Assignee: Kabushiki Kaisha Kobe Seiko Sho (Kobe Steel, Ltd.), Kobe (JP) --

Signed and Sealed this

First Day of June, 2004

JON W. DUDAS
*Acting Director of the United States Patent and Trademark Office*